US005669351A

United States Patent [19]

Shirai et al.

[11] Patent Number: 5,669,351

[45] Date of Patent: Sep. 23, 1997

[54] ENGINE THROTTLE CONTROL WITH VARYING CONTROL CONSTANTS

[75] Inventors: Kazunari Shirai, Chita-gun; Hidemasa Miyano, Kariya; Shigeru Kamio, Nagoya; Yoshimasa Nakaya, Nagoya, all of Japan

[73] Assignee: Nippondenso Co., Ltd., Kariya, Japan

[21] Appl. No.: 607,138

[22] Filed: Feb. 26, 1996

[30] Foreign Application Priority Data

Mar. 28, 1995 [JP] Japan ..... 7-069294

[51] Int. Cl.[6] ..... F02D 9/00

[52] U.S. Cl. ..... 123/339.21; 123/399; 180/179; 180/197

[58] Field of Search ..... 123/339.19, 339.21, 123/352, 361, 399; 180/179, 197

[56] References Cited

U.S. PATENT DOCUMENTS

| | | | |
|---|---|---|---|
| 4,513,711 | 4/1985 | Braun et al. | 123/352 X |
| 4,985,837 | 1/1991 | Togai al. | 180/197 X |
| 5,069,181 | 12/1991 | Togai et al. | 123/399 X |
| 5,088,461 | 2/1992 | Ohashi et al. | 123/399 |
| 5,152,266 | 10/1992 | Sekiguchi et al. | 123/357 |
| 5,155,686 | 10/1992 | Shiraishi et al. | 180/197 X |

FOREIGN PATENT DOCUMENTS

| | | |
|---|---|---|
| 63-198437 | 12/1988 | Japan . |
| 3-217338 | 9/1991 | Japan . |
| 5-233077 | 9/1993 | Japan . |

*Primary Examiner*—Tony M. Argenbright
*Attorney, Agent, or Firm*—Nixon & Vanderhye P.C.

[57] ABSTRACT

ECU performs a feedback control on a d.c. motor by a PID feedback control thereby to reduce errors between an actual throttle opening and a command throttle opening. PID control constants Kp, Ti and Td in the PID control are determined in accordance with operating conditions of a vehicle, such as engine idle speed control condition, vehicle traction control condition, vehicle cruise control condition and the like.

21 Claims, 3 Drawing Sheets

| | ISC | TRC | C/C | NORMAL |
|---|---|---|---|---|
| Kpt | 1 | 10 | 5 | 7 |
| Tdt | 10 | 1 | 5 | 3 |
| Tit | 3 | 3 | 3 | 3 |

ENGINE THROTTLE CONTROL WITH VARYING CONTROL CONSTANTS

BACKGROUND OF THE INVENTION

1. Field of the Invention

The present invention relates to a throttle control apparatus for an internal combustion engine which controls opening of a throttle valve electronically in accordance with depression amounts of an accelerator pedal.

2. Description of Related Art

Known heretofore is a throttle control apparatus for an internal combustion engine called "an electronic throttle system" which controls opening of a throttle valve by driving a d.c. motor in accordance with a depression amount of an accelerator pedal, i.e., accelerator position.

In this throttle control, an electric current is supplied to the d.c. motor in accordance with a signal from an accelerator position sensor which detects accelerator position corresponding to the depression amount of the accelerator pedal. By driving the d.c. motor, the throttle valve is opened and closed to control an intake air amount to the engine. A feedback control of the proportional, integral and derivative control (hereinafter referred to simply as PID control) is performed on the d.c. motor to reduce errors between a signal from a throttle opening sensor which detects an actual throttle opening of the throttle valve and the signal from the accelerator position sensor.

It has been a general design practice to determine each control constant of P(proportional)-term, I(integral)-term and D(derivative)-term of the PID control to fixed intermediate values to meet requirements under all operating conditions of the system. Since the control constants thus determined do not become the optimum values for specific operating conditions, responsiveness, stability and the like of the throttle valve control are degraded.

That is, during an idle speed control (hereinafter referred to simply as ISC) which stabilizes an engine rotational speed to a predetermined speed under engine idle condition, for instance, the response speed of the throttle valve may be low but the stability must be high. Further, during a traction control (hereinafter referred to simply as TRC) which optimally controls driving force of driving wheels driven by the internal combustion engine in accordance with road surface conditions, the stability of the throttle valve may be lowered to some extent but the response speed must be maintained high as opposed to the time of the ISC control. Still further, during a cruise control (hereinafter referred to simply as C/C) which controls a constant speed running of a vehicle without operating an accelerator pedal, both responsiveness and stability are required to the same extent.

SUMMARY OF THE INVENTION

The present invention has been made to overcome the above described drawbacks.

It is an object of the present invention to provide a throttle control for an internal combustion engine which has optimum responsiveness and stability of a throttle valve corresponding to operating conditions of a vehicle.

In a throttle control for an internal combustion engine according to the present invention, a throttle valve is controlled by performing a PID feedback control with control constants of the PID feedback control being varied in accordance with vehicle operating conditions.

Preferably, the control constants of the PID feedback control are determined exclusively for ISC, TRC, C/C or the like the specific operating condition of the vehicle.

BRIEF DESCRIPTION OF THE DRAWINGS

The construction, operation and features of the present invention will become more apparent from the following description when read with reference to the accompanying drawings in which.

DETAILED DESCRIPTION OF A PRESENTLY PREFERRED EMBODIMENT

The present invention will be described hereinafter with reference to a presently preferred exemplary embodiment.

Figure 1:
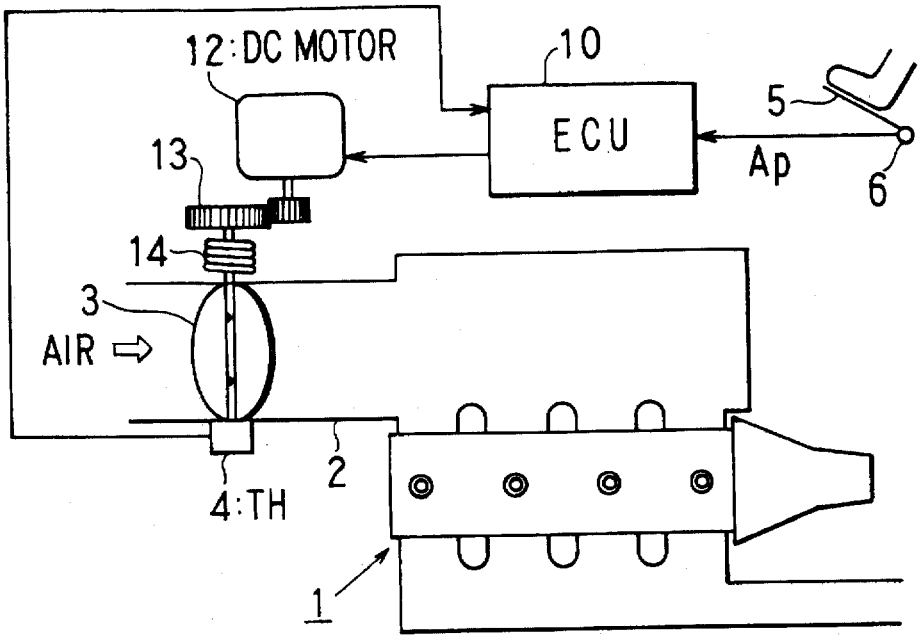
FIG. 1 is a schematic view illustrating a whole construction of a throttle control apparatus for an internal combustion engine according to one embodiment of the present invention.
Figure 2:
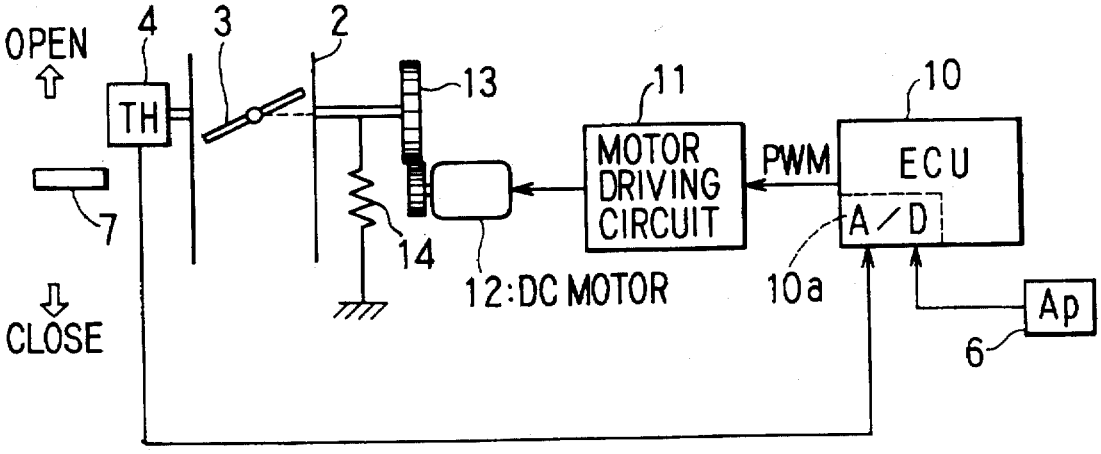
FIG. 2 is a block diagram illustrating a construction of a major part of the throttle control apparatus according to the embodiment of FIG. 1.

Referring first to FIGS. 1 and 2 illustrating one embodiment of a throttle control apparatus, an internal combustion engine 1 has an intake air passage 2 through which air is supplied. A throttle valve 3 is disposed rotatably in the intake air passage 2 for intake air flow control. A throttle opening sensor (TH) 4 is linked with the throttle valve 3 for detecting throttle openings. An accelerator position sensor 6 is linked with an accelerator pedal 5 for detecting accelerator pedal positions. A full-closure stopper 7 is provided to restrict full-closure position of the throttle valve 3.

An ECU (electronic Control Unit) 10 is connected to receive a throttle opening signal TH from the throttle opening sensor 4 and an accelerator position signal Ap from the accelerator position sensor 6. The ECU 10 is further connected to a d.c. motor 12 as an actuator for supplying an electric current for motor rotation. A gear mechanism 13 is disposed between the d.c. motor 12 and the throttle valve 3, and a return spring 14 is coupled with the throttle valve 3 to normally bias the throttle valve 3 toward the full-closure side.

As illustrated in FIG. 2, the accelerator position signal Ap from the accelerator position sensor 6 indicative of to the depression amount of the accelerator pedal 5 and the throttle opening signal TH from the throttle opening sensor 4 indicative of the throttle opening of the throttle valve 3 are A/D-converted by an A/D converter 10*a* of the ECU 10. In response to those signals the ECU 10, specifically CPU (not illustrated) thereof, produces a PWM (Pulse width Modulation) signal to a motor driving circuit 11. The motor driving circuit 11 supplies the d.c. motor 12 with the electric current. The d.c. motor 12 driven thus opens and closes the throttle valve 3 via the gear mechanism 13.

Figures 3, 5:
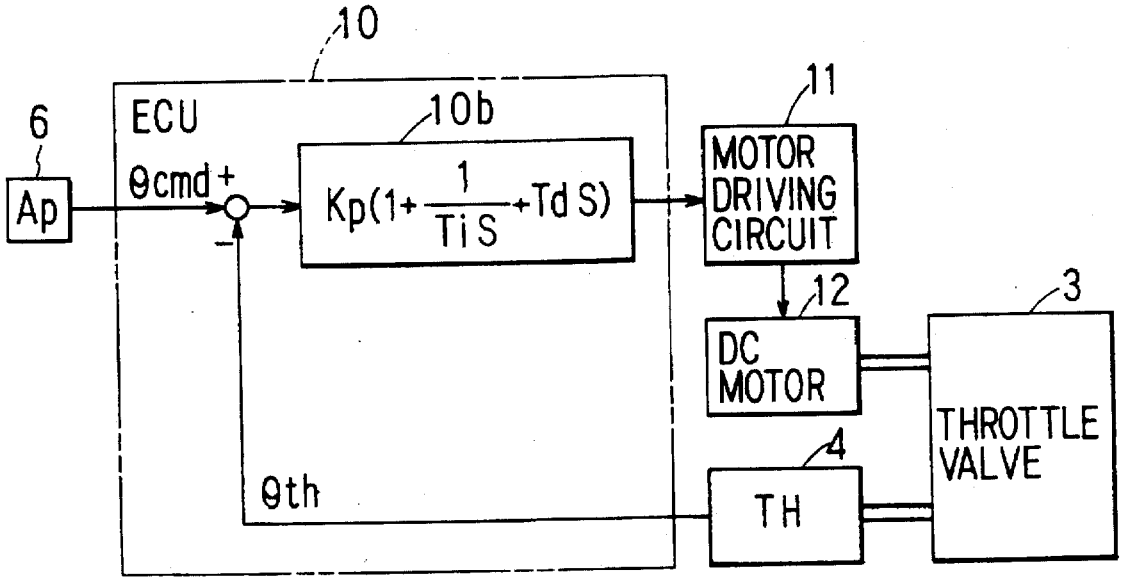
FIG. 3 is a diagram illustrating a signal flow in the throttle control apparatus according to the embodiment of FIG. 1.
FIG. 5 is a map data illustrating control constants used in the throttle control apparatus according to the embodiment of FIG. 1.

In this instance, as shown in FIG. 3, the ECU 10 performs the feedback control on the d.c. motor 12 through the motor driving circuit 11 by the PID control of the PID control circuit 10*b*. The PID control circuit 10*b* calculates the control amounts based on the equation (4) having proportional, integral and derivative terms and to be discussed later. Thus, the ECU 10 reduces errors between an actual throttle opening θth calculated based on the throttle opening signal TH of the throttle opening sensor 4 which detects the throttle opening of the throttle valve 3 and a target or command throttle opening θcmd calculated based on the accelerator position signal Ap from the accelerator position sensor 6 which detects the accelerator position of the accelerator pedal 5.

Described next is a relation between the P-term gain, I-term gain and D-term gain, which are the control constants of the respective P(proportional)-term, I(Integral)-term and D(Derivative)-term in the PID control, and the control characteristic of the throttle valve 3.

The P-term gain controls changing rate of the opening and closing, that is, response speed of the throttle valve. Therefore, the response speed of the throttle valve becomes faster as the P-term gain becomes larger. This, however, tends to cause the larger overshooting as a reaction which would result in hunting or oscillation at the time of controlling the throttle opening to the specified opening.

The I-term gain reduces the errors between the command throttle opening of the throttle valve and the actual throttle opening. Therefore, the movement of the throttle valve becomes larger as the I-term gain becomes larger and results in hunting at the time of controlling the throttle opening to the specified opening.

Finally, the D-term gain controls the final converging speed of the response speed in the opening and closing of the throttle valve. Therefore, the response speed of the throttle valve becomes slower as the D-term gain becomes larger. On the contrary, the overshooting becomes smaller at the time of changes in throttle opening of the throttle valve.

Figure 4:
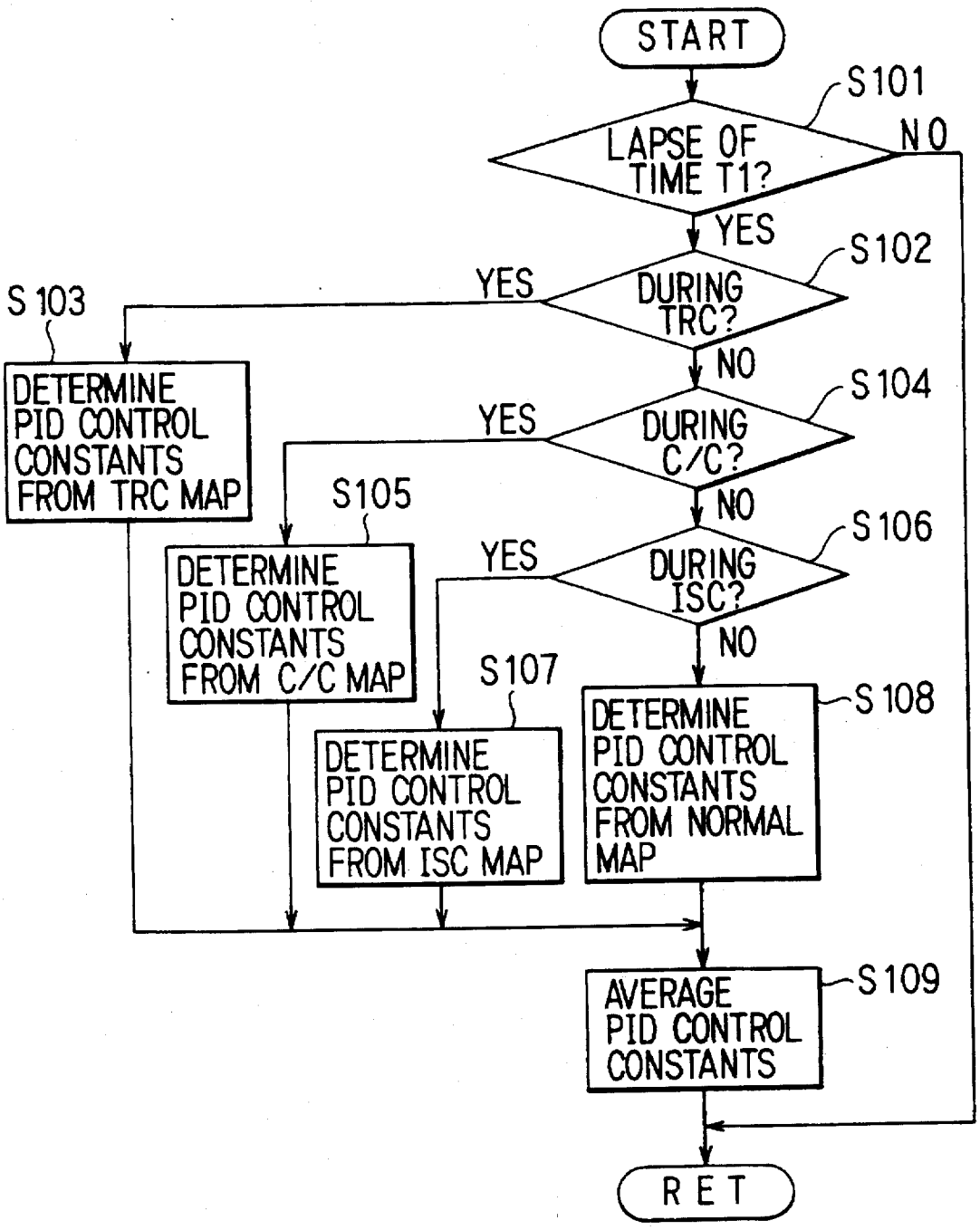
FIG. 4 is a flowchart illustrating a control process of an ECU of the throttle control apparatus according to the embodiment of FIG. 1.

A control process of the ECU 10 is described next based on a flowchart of FIG. 4 with reference to FIG. 5 which illustrates a map data of the PID control constants corresponding to each operating condition.

First at step S101, it is determined whether a time T1 (4 ms–8 ms) has elapsed after the preceding determination. When the determination requirement of step S101 is not met, the routine ends. When the determination requirement of step S101 is met, on the other hand, the process proceeds to step S102 to determine whether it is in the TRC control based on a slip condition of wheels. When the determination requirement is met, that is, wheel speed of driving wheel is larger than wheel speed of driven wheels, it is determined as slipping and in the TRC control by which the throttle valve is driven in the closing direction to reduce the engine output torque. Then, proceeding to step S103, the PID control constants are determined from a TRC map data shown in FIG. 5. That is, during the TRC control, the P-term constant Kpt and D-term constant Tdt are determined to be larger and smaller than those of normal operating condition. Thus, the responsiveness of the throttle valve control is enhanced and it becomes possible to change the driving force of driving wheel in correspondence to road surface conditions.

When the determination requirement of step S102 is not met, the process proceeds to step S104 to determine whether it is in the C/C control. Here, C/C control starts and continues when a C/C main switch and C/C set switch (both not illustrated) are turned on, while it ends when a brake is depressed, a C/C cancel switch (not illustrated) is turned on or the C/C main switch is turned off. When the determination requirement of step S104 is met, the process proceeds to step S105 to determine the PID control constants from a C/C map data shown in FIG. 5. In this case, the P-term constant Kpt and D-term constant Tdt are determined to be smaller and larger than those of the normal operating condition, while those two constants are determined to be equal to each other. Thus, both the responsiveness and stability of the throttle control are enhanced.

When the determination requirement of step S104 is not met, it proceeds to step S106 to determine whether it is in the ISC control. With regard to the requirement for the ISC, ISC control starts to continue when a vehicle speed is zero and the throttle opening is equal to or smaller than a predetermined opening. When the determination requirement of step S106 is met, the process proceeds to step S107 to determine the PID control constants from an ISC map data shown in FIG. 5. During the ISC control, the P-term constant Kpt and D-term constant Tdt is determined smaller and larger than those of the case of normal operating condition, respectively. Therefore, the stability of the throttle valve control during ISC is enhanced.

When the determination requirement of step S106 is not met, the process proceeds to step S108 to determine the PID constants from a normal map data shown in FIG. 5. After the processing of step S103, S105, S107 or S108, it proceeds to step S109 to average each PID control constant and ends the routine. By this averaging of each constant, abrupt change in the throttle control may be prevented even when the control constant is changed largely due to abrupt change in the vehicle operating conditions.

As the method of averaging the PID control constants, the following equations (1), (2) and (3) which are called as exponential averaging are used. Here, symbol ρ is a predetermined filtering constant selected from the range of $0<\rho<1$. As understood from the following equations (1), (2) and (3), as the value of ρ becomes larger, the filtered values more quickly approach the new PID control constants.

[Equation 1]

$$Kpn=(1-\rho)\times Kpn-1+\rho\times Kpt \quad (1)$$

[Equation 2]

$$Tdn=(1-\rho)\times Tdn-1+\rho\times Tdt \quad (2)$$

[Equation 3]

$$Tin=(1-\rho)\times Tin-1+\rho\times Tit \quad (3)$$

Thus, the P(Proportional)-term gain Kp, D(Derivative)-term gain Td and I(Integral)-term gain Ti of the PID control are determined from the above equations (1), (2) and (3), and substituted into the following equation (4) to determine a PID control equation G of the PID control circuit **10*b* in the ECU 10 of FIG. 3**. In the equation (4), symbol S denotes a Laplace operator.

[Equation 4]

$$G=Kp\{1+1/(Ti\times S)+Td\times S\} \quad (4)$$

The PID of the equation (4) is a general expression, and it is also possible to apply the foregoing method to PID controls which are expressed in other specific equations.

The present invention having been described with reference to the exemplary embodiment should not be limited thereto but may be modified in many other ways without departing from the spirit of the invention.

What is claimed is:

1. A throttle control apparatus for an internal combustion engine which controls a throttle valve opening through an electric actuator in accordance with accelerator pedal depression, said apparatus comprising:

target opening setting means for setting a target opening of said throttle valve in accordance with accelerator pedal depression;

deviation calculating means for calculating deviation of actual throttle valve opening from said target opening;

throttle valve control means for controlling said throttle valve through said electric actuator by performing a proportional, integral and derivative control on said calculated deviation; and control constant determining means for determining control constants of said proportional, integral and derivative control in accordance with vehicle operating conditions, at least one of said constants of said proportional control and said derivative control being varied between a normal and a specified other vehicle operating condition.

2. A throttle control apparatus for an internal combustion engine according to claim 1, wherein said control constant determining means varies said at least one of said control constants when said engine comes into an idle speed control condition as said specified other operating condition from said normal operating condition.

3. A throttle control apparatus for an internal combustion engine according to claim 2, wherein said control constant determining means varies said proportional control constant and said derivative control constant to be respectively smaller and larger at the time of said idle speed operating condition than those of said normal operating condition.

4. A throttle control apparatus for an internal combustion engine according to claim 1, wherein said control constant determining means determines said control constants when said engine comes into a traction control operating condition.

5. A throttle control apparatus for an internal combustion engine according to claim 4, wherein said control constant determining means determines said proportional control constant and said derivative control constant to be respectively larger and smaller at the time of said traction control operating condition than those of a normal operating condition.

6. A throttle control apparatus for an internal combustion engine according to claim 1, wherein said control constant determining means determines said control constants when said engine comes into a cruise control operating condition for running a vehicle at constant speed.

7. A throttle control apparatus for an internal combustion engine according to claim 6, wherein said control constant determining means determines said proportional control constant and said derivative control constant to be respectively smaller and larger at the time of said cruise control operating condition than those of a normal operating condition, respectively.

8. A throttle control apparatus for an internal combustion engine according to claim 2, wherein said control constant determining means determines said control constants when said engine comes into a traction control operating condition.

9. A throttle control apparatus for an internal combustion engine according to claim 2, wherein said control constant determining means determines said control constants when said engine comes into a cruise control operating condition for running a vehicle at constant speed.

10. A throttle control apparatus for an internal combustion engine according to claim 4, wherein said control constant determining means determines said control constants when said engine comes into a cruise control operating condition for running a vehicle at constant speed.

11. A throttle control apparatus for an internal combustion engine according to claim 8, wherein said control constant determining means determines said control constants when said engine comes into a cruise control operating condition for running a vehicle at constant speed.

12. A throttle control apparatus for an internal combustion engine according to claim 1, wherein said control constant determining means determines said control constants by averaging newly selected control constants with prior selected control constants.

13. A throttle control apparatus for an internal combustion engine according to claim 2, wherein said control constant determining means determines said control constants by averaging newly selected control constants with prior selected control constants.

14. A throttle control apparatus for an internal combustion engine according to claim 4, wherein said control constant determining means determines said control constants by averaging newly selected control constants with prior selected control constants.

15. A throttle control apparatus for an internal combustion engine according to claim 6, wherein said control constant determining means determines said control constants by averaging newly selected control constants with prior selected control constants.

16. A throttle control apparatus for an internal combustion engine according to claim 11, wherein said control constant determining means determines said control constants by averaging newly selected control constants with prior selected control constants.

17. An electronic throttle control method for an engine having a throttle valve driven under both a normal control mode and a specified other control mode including at least one of an idle speed control mode, a traction control mode and a cruise control mode, said electronic throttle control method comprising the steps of:

determining deviation between throttle opening and a target throttle opening determined by accelerator position;

determining throttle valve control by performing proportional, integral and derivative calculation on said deviation; and varying at least one of gains of said proportional, said integral and said derivative calculations when the engine passes between said normal control mode and said specified other control mode.

18. An electronic throttle control method according to claim 17, wherein:

said varying step varies the gains of said proportional and derivative calculations and maintains the gain of said integral calculation constant when the engine passes between said two control modes.

19. An electronic throttle control method according to claim 17, wherein:

said specified control mode includes said idle speed control mode; and said varying step decreases and increases the gains of said proportional calculation and said derivative calculation respectively to a smaller value and a larger value at the time of said idle speed control mode than during normal control mode.

20. An electronic throttle control method according to claim 17, wherein:

said specified control mode includes said traction control mode; and said varying step increases and decreases the gains of said proportional calculation and said derivative calculation respectively to a larger value and a smaller value at the time of said traction control mode than during normal control mode.

21. An electronic throttle control method according to claim 17, wherein:

said specified throttle control mode includes said cruise control mode; and said varying step decreases and increases the gains of said proportional calculation and said derivative calculation respectively to a smaller value and a larger value at the time of said cruise control mode than during normal control mode.

* * * * *